US009856891B2

(12) United States Patent
Rabhi

(10) Patent No.: US 9,856,891 B2
(45) Date of Patent: Jan. 2, 2018

(54) TRAVEL END EXPANSION VALVE FOR PISTON TYPE PRESSURE CONVERTER

(71) Applicant: Vianney Rabhi, Lyons (FR)

(72) Inventor: Vianney Rabhi, Lyons (FR)

( * ) Notice: Subject to any disclaimer, the term of this patent is extended or adjusted under 35 U.S.C. 154(b) by 424 days.

(21) Appl. No.: 14/709,036

(22) Filed: May 11, 2015

(65) Prior Publication Data

US 2015/0322976 A1 Nov. 12, 2015

Related U.S. Application Data

(60) Provisional application No. 62/015,612, filed on Jun. 23, 2014, provisional application No. 61/993,122, filed on May 14, 2014.

(30) Foreign Application Priority Data

May 12, 2014 (FR) ..... 14 54223
Jun. 20, 2014 (FR) ..... 14 55710

(51) Int. Cl.

| | |
|---|---|
| ***F15B 13/06*** | (2006.01) |
| ***F15B 11/16*** | (2006.01) |
| ***F15B 15/17*** | (2006.01) |
| ***F04B 9/04*** | (2006.01) |
| ***F15B 3/00*** | (2006.01) |
| ***F04B 9/107*** | (2006.01) |

(52) U.S. Cl.

CPC ..... *F15B 13/06* (2013.01); *F04B 9/04* (2013.01); *F04B 9/107* (2013.01); *F04B 9/1076* (2013.01); *F15B 3/00* (2013.01); *F15B 11/16* (2013.01); *F15B 15/17* (2013.01)

(58) Field of Classification Search

CPC .. F15B 1/024; F15B 1/033; F15B 3/00; F04B 9/113

See application file for complete search history.

(56) References Cited

U.S. PATENT DOCUMENTS

| | | | | |
|---|---|---|---|---|
| 4,347,701 A * | 9/1982 | Eddens | B60K 3/00 | 180/305 |
| 5,111,659 A * | 5/1992 | Klein | B60T 13/14 | 303/113.1 |
| 7,475,538 B2 * | 1/2009 | Bishop | E02F 9/22 | 60/567 |
| 2015/0053075 A1 * | 2/2015 | Rabhi | F04B 9/113 | 91/417 R |

FOREIGN PATENT DOCUMENTS

AT WO 0068578 A1 * 11/2000 ..... F04B 9/135

* cited by examiner

*Primary Examiner* — Thomas E Lazo
(74) *Attorney, Agent, or Firm* — Young & Thompson

(57) ABSTRACT

The travel end expansion valve (1) for a piston type pressure converter (2) whose master cylinder (3) and slave cylinder (4) define a master chamber (9) and a slave chamber (10), respectively, includes an expansion master cylinder (12) which communicates with the slave chamber (10) and in which there can move an expansion main master piston (14) which is mechanically connected by a lever type transmission (11) with progressive effect to an expansion slave pump piston (15) which can move in an expansion slave cylinder (13), the transmission (11) being provided in such a manner that, when the expansion main master piston (14) is at the top dead center, the expansion slave pump piston (15) is at the bottom dead center, and vice versa, while an expansion release actuator (30) can cause the transmission (11) to move.

12 Claims, 5 Drawing Sheets

TRAVEL END EXPANSION VALVE FOR PISTON TYPE PRESSURE CONVERTER

FIELD OF THE INVENTION

The present invention relates to a travel end expansion valve for a piston type pressure converter.

BACKGROUND OF THE INVENTION

Piston type pressure increasing or decreasing units are generally constituted by at least one master cylinder, in which there can move a master piston which is rigidly connected to at least one slave piston which can move in a slave cylinder, the two pistons moving over the same path but having a different cross-section. Each piston cooperates with a cylinder and a cylinder head in order to form a closed and sealed space having a variable volume. The master cylinder communicates with a hydraulic circuit which is independent of the circuit of the slave cylinder.

Piston type pressure increasing or decreasing units may be used in a static manner in order to maintain two circuits or two volumes which are independent of each other at a constant pressure ratio without there necessarily being established a flow of hydraulic fluid which involves the displacement of the master piston and the slave piston.

In the case of piston type pressure increasing units which convert a hydraulic fluid flow into a hydraulic fluid flow which is smaller but under greater pressure, or in the case of the or piston type pressure decreasing units which convert a hydraulic fluid flow into a hydraulic fluid flow which is greater but under lower pressure, the master piston constitutes a hydraulic motor which converts a hydraulic fluid flow into movement, the movement being communicated to the slave piston which forms a hydraulic pump so as to convert the movement into a hydraulic fluid flow. In order to increase the pressure, the master piston must have a cross-section larger than that of the slave piston whilst, in order to reduce the pressure, the master piston must have a cross-section smaller than that of the slave piston.

In this case, it may be noted that the master cylinder comprises at least one inlet and at least one outlet which may each be kept open or closed by a valve while the slave cylinder has at least one inlet which comprises a non-return valve which allows the hydraulic fluid to be introduced into the cylinder but not to be discharged therefrom and at least one outlet which comprises a non-return valve which allows the hydraulic fluid to be discharged from the cylinder but not to be introduced therein.

When a flow is durably established through the piston type increasing or decreasing units, the operation thereof is sequential because, when the pistons which they comprise reach the travel end, the pistons must return to the travel start, and vice versa, as long as the increasing or decreasing units operate. That sequential operation is responsible for losses of energy which are undesirable owing to the compressibility of the hydraulic fluid, the losses being proportionally greater when the fluid is compressible and the pressures used are high. For the same operating pressures, the losses are proportionally greater if a pressure decreasing unit is involved, the losses occurring mainly in the region of the master cylinder of the decreasing unit.

In practice, for pressures of several tens or hundreds of bar, the performance of the piston type pressure increasing or decreasing units remains high. When those piston type pressure increasing or decreasing units are used at pressures which are still higher—for example, in the order of a thousand bar or more—the compression rate of the hydraulic fluid is increased, which further worsens the performance, even when fluids which are known to be poorly compressible, such as oil or water, are used.

This is because energy is stored during the compression of the hydraulic fluid, but the energy is normally lost at the end of travel of the pistons, mainly at the side of the master piston. That results from the fact that, when the piston arrives at the end of travel, the master cylinder in which it moves is completely filled with pressurized fluid. Therefore, so that the master piston can move off again in the opposite direction, it is first necessary to decompress the fluid contained in the cylinder. The loss of energy results from the inability to convert the compression energy of the fluid into an additional flow of pressurized fluid which is available at the outlet of the slave cylinder, unless the whole of the circuit which is connected to the outlet of the slave cylinder is decompressed at the same proportions, which is rarely possible.

This is because, in practice, when the master piston arrives at the end of travel, the master cylinder thereof is decompressed in a low-pressure circuit without compensation during operating production, and the compression energy stored in the hydraulic fluid is dissipated in the form of heat. In accordance with the application considered, that loss makes the use of pressure increasing or decreasing units largely irrelevant.

In this regard, it would be particularly advantageous to be able to recover this compression energy, particularly involving piston type pressure increasing or decreasing units which operate under very high pressures.

For example, the reversible hydraulic pressure converter having tubular valves, to which the patent application No. 1358071 of 20 Aug. 2013 belonging to the same Applicant relates, would have its energy performance level substantially increased if it cooperated with recovery means for the compression energy of the hydraulic fluid, whatever the context of the application of the converter. It should further be noted that, if the converter is used in order to produce motor vehicles with hydraulic hybrid transmission with storage/restitution of pressurized oil, it becomes particularly advantageous to recover the compression energy of the hydraulic fluid in the converter, which allows the consumption of fuel per kilometer of the vehicles to be reduced.

The advantage in terms of energy brought about by recovery means for the compression energy of the hydraulic fluid would also benefit any sequential pressure converter, increasing unit or decreasing unit with pistons, whatever the number of master pistons or slave pistons which it comprises, and whatever the field of application thereof.

SUMMARY OF THE INVENTION

Therefore, in order to improve the performance level of piston type pressure increasing units, pressure decreasing units or pressure conversion units, the travel end expansion valve for a piston type pressure converter according to the invention proposes, according to the embodiment under consideration:

- converting—when the master piston arrives at the travel end—a significant portion of the compression energy of the hydraulic fluid into an additional flow which is discharged from the slave cylinder, without producing a substantial reduction in pressure at the outlet thereof;
- a simple production and a moderate cost price;
- great strength and service-life;

a capacity for operation in the range of very high pressure up to two thousand bar and above.

The other features of the present invention have been described in the description and in the secondary claims which are dependent directly or indirectly on the main claim.

The travel end expansion valve according to the invention, which is provided for a piston type pressure converter which comprises at least one master cylinder, in which a main master piston can move so as to define a master chamber which has a variable volume and which can be placed in a relationship with a master intake conduit by a master intake valve or with a master discharge conduit by a master discharge valve, the pressure converter also comprising at least one slave cylinder, in which a pump slave piston can move so as to define a slave chamber which also has a variable volume, that chamber being able to admit a hydraulic fluid from a slave intake conduit via a slave intake valve member or to discharge the fluid into a slave discharge conduit via a slave discharge valve member, the master chamber and the slave chamber each being filled with a hydraulic fluid, comprises:

at least one expansion master cylinder which is filled with a hydraulic fluid and in which an expansion main master piston can move so as to define an expansion master chamber which has a variable volume and which communicates with the master chamber and/or at least one expansion master cylinder which is filled with a hydraulic fluid and in which an expansion main master piston can move so as to define an expansion master chamber which has a variable volume and which communicates with the slave chamber;

at least one expansion slave cylinder which cooperates with the expansion master cylinder and in which an expansion pump slave piston can move so as to define with the slave cylinder an expansion slave chamber which has a variable volume and which is filled with a hydraulic fluid, the pump slave piston being mechanically connected to the expansion main master piston by a lever type transmission which has a progressive effect and which is arranged in such a manner that, when the expansion main master piston is at the top dead center, the expansion pump slave piston is at the bottom dead center, and vice versa, while the maximum volume of the expansion slave chamber is less than the maximum volume of the expansion master chamber;

at least one expansion slave intake valve member which opens in the expansion slave chamber and which allows a hydraulic fluid which is contained in an expansion slave intake conduit to be introduced into the slave chamber but not to be discharged therefrom;

at least one expansion slave discharge valve member which opens in the expansion slave chamber and which allows a hydraulic fluid which is contained in an expansion slave discharge conduit to be discharged from the slave chamber but not to be introduced therein;

at least one expansion release actuator which can, by means of contact or mechanical connection, cause to move or release the lever type transmission with progressive effect.

The travel end expansion valve according to the present invention comprises an expansion slave intake conduit which is connected via the expansion slave intake valve member to the expansion slave chamber which cooperates with the expansion master chamber which has a variable volume and which communicates with the slave chamber which is connected to the slave intake conduit while the expansion slave discharge conduit which is connected to the same expansion slave chamber is connected to the slave discharge conduit.

The travel end expansion valve according to the present invention comprises an expansion slave intake conduit which is connected via the expansion slave intake valve member to the expansion slave chamber which cooperates with the expansion master chamber which has a variable volume and which communicates with the master chamber which is connected to the master discharge conduit while the expansion slave discharge conduit which is connected to the same expansion slave chamber is connected—upstream of the master intake valve—to the master intake conduit.

The travel end expansion valve according to the present invention comprises a lever type transmission with progressive effect which comprises a return spring for the expansion pistons, which spring tends to maintain the expansion main master piston in the region of the position thereof, in which the expansion master chamber has the smallest volume while, simultaneously, the spring allows the expansion slave pump piston to be maintained in the region of the position thereof in which the expansion slave chamber has the largest volume.

The travel end expansion valve according to the present invention comprises a lever type transmission with progressive effect which is constituted by a crankshaft which can rotate in a crankshaft bearing and which comprises an expansion master piston crank whose cranked crankpin is connected to an expansion main master piston axle which is fitted in the expansion main master piston by an expansion master piston connecting rod, the first end of which is articulated about the crankpin and the second end of which is articulated about the axle, the crankshaft cooperating with secondary expansion transmission means which mechanically connect the shaft to the expansion slave pump piston.

The travel end expansion valve according to the present invention comprises secondary expansion transmission means which are constituted by an expansion transmission toothed wheel which is fixedly joined in terms of rotation to the crankshaft and which, when it rotates, drives in terms of linear translation an expansion transmission rack which is connected to the expansion slave pump piston.

The travel end expansion valve according to the present invention comprises secondary expansion transmission means which are constituted by an expansion slave piston crank which is fixedly joined in terms of rotation to the crankshaft and the cranked crankpin of which is connected to an expansion slave pump piston axle which is fitted in the expansion slave pump piston by an expansion slave piston connecting rod, the first end of which is articulated about the crankpin and the second end of which is articulated about the axle.

The travel end expansion valve according to the present invention comprises a lever type transmission with progressive effect which is constituted by a camshaft which can rotate in a camshaft bearing and which comprises an expansion master piston cam which can be maintained in contact with the expansion main master piston and an expansion slave piston cam which can be maintained in contact with the expansion slave pump piston.

The travel end expansion valve according to the present invention comprises a crankshaft or an expansion master piston crank or an expansion master piston connecting rod or an expansion transmission toothed wheel or an expansion transmission rack or an expansion slave piston crank or an expansion slave piston connecting rod or a camshaft or an expansion master piston cam or an expansion slave piston cam which has an expansion release push stop, to which the expansion release actuator can apply an effort by means of an expansion release touch needle.

BRIEF DESCRIPTION OF THE DRAWINGS

The following description with regard to the appended drawings, which are given by way of non-limiting example, will allow a better understanding of the invention, the features which it has and the advantages which it is capable of bringing about.

DETAILED DESCRIPTION OF THE INVENTION

Figure 1:
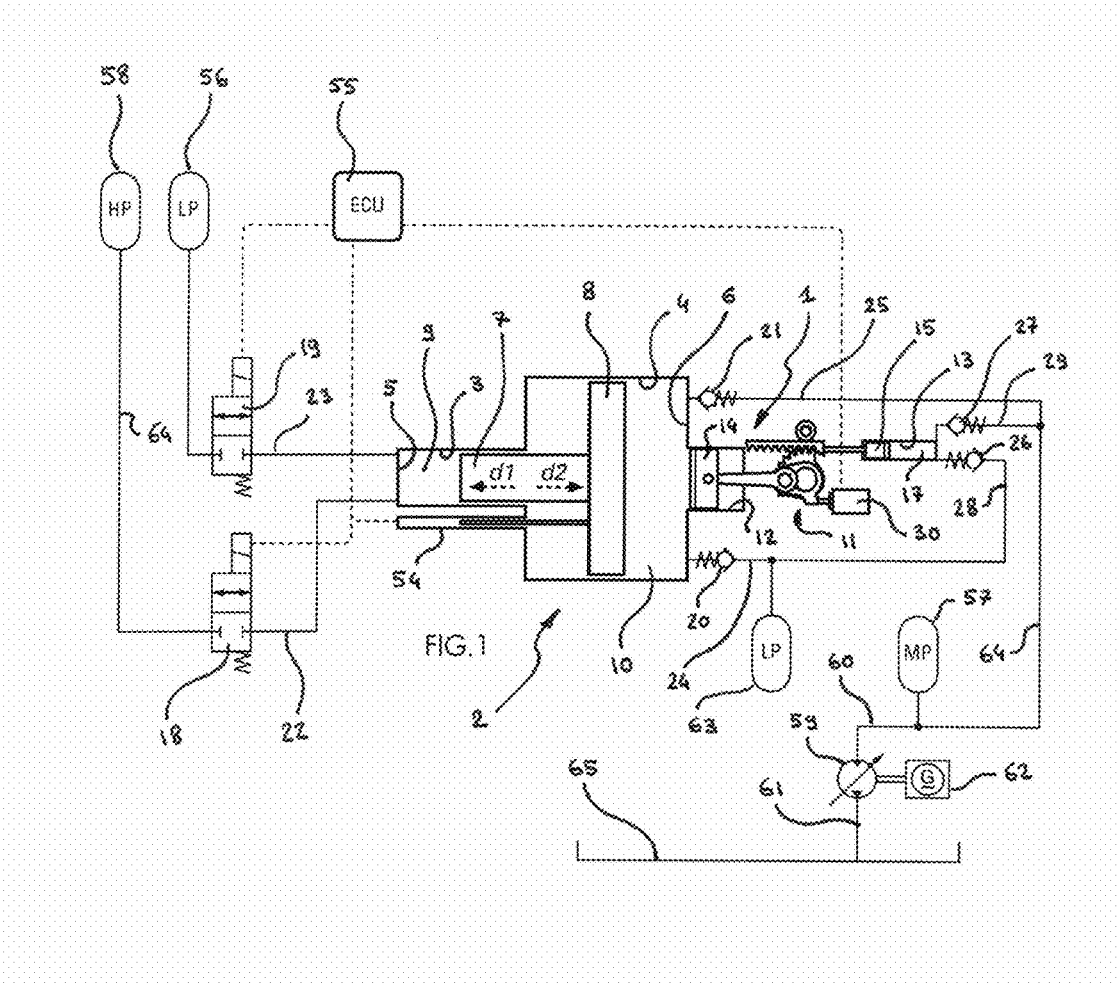
FIG. 1 is a schematic illustration of the travel end expansion valve for a piston type pressure converter according to the present invention as may be provided in order to cooperate with a piston type pressure converter having a single master chamber and a single slave chamber, the converter being used in order to convert a flow of hydraulic fluid under high pressure from a high-pressure fluid reservoir into a medium-pressure flow of hydraulic fluid, in order to drive a medium-pressure hydraulic motor which is connected to an electricity generator.

FIGS. 1 to 8 show the travel end expansion valve 1 for a piston type pressure converter 2 which comprises at least one master cylinder 3 in which a main master piston 7 can move so as to define a master chamber 9 which has a variable volume and which can be placed in a relationship with a master intake conduit 22 by a master intake valve 18 or with a master discharge conduit 23 by a master discharge valve 19, the pressure converter 2 also comprising at least one slave cylinder 4, in which a slave pump piston 8 can move so as to define a slave chamber 10 which also has a variable volume, that chamber being able to admit a hydraulic fluid from a slave intake conduit 24 via a slave intake valve member 20 or to discharge the fluid into a slave discharge conduit 25 via a slave discharge valve member 21, the master chamber 9 and the slave chamber 10 each being filled with a hydraulic fluid.

Figure 2:
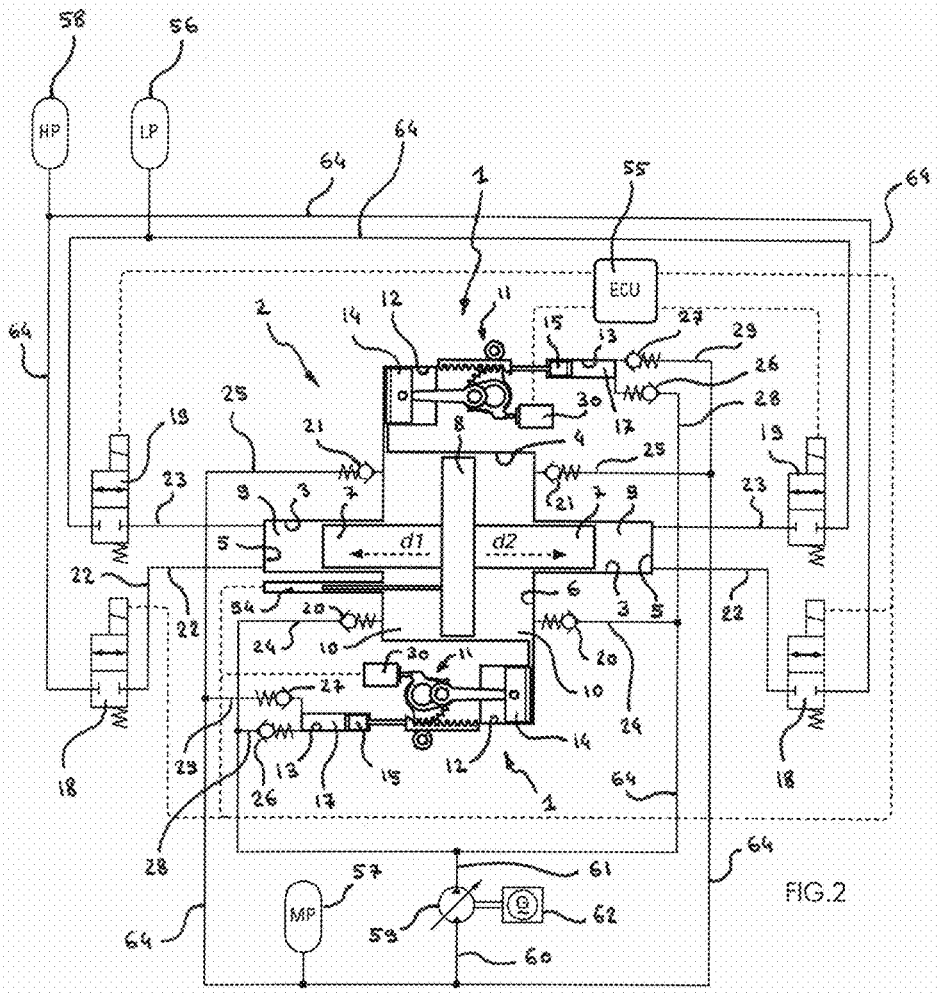
FIG. 2 is a schematic illustration of the travel end expansion valve for a piston type pressure converter according to the present invention as may be provided in order to cooperate with a piston type pressure converter having two master chambers and two slave chambers, the converter being used in order to convert a flow of hydraulic fluid under high pressure from a high-pressure fluid reservoir into a medium-pressure flow of hydraulic fluid, in order to drive a medium-pressure hydraulic motor which is connected to an electricity generator.

FIGS. 1 and 2 show that the travel end expansion valve 1 according to the invention comprises at least one expansion master cylinder 12 which is filled with a hydraulic fluid and in which an expansion main master piston 14 can move so as to define an expansion master chamber 16 which has a variable volume and which communicates with the slave chamber 10.

By way of a variant which is not illustrated and which may replace or supplement the preceding one, the travel end expansion valve 1 comprises at least one expansion master cylinder 12 which is filled with a hydraulic fluid and in which an expansion main master piston 14 can move so as to define an expansion master chamber 16 which has a variable volume and which communicates with the master chamber 9.

It should be noted that the expansion master chamber 16 may communicate—depending on the situation—either with the master chamber 9 or with the slave chamber 10 by means of a conduit which is fitted in an expansion master cylinder head 44 which covers the expansion master cylinder 12, or simply because the expansion master cylinder 12 opens directly either in the master chamber 9 or in the slave chamber 10. In the last case, the master cylinder 12 does not comprise an expansion master cylinder head 44 and may open at the internal surface of a master cylinder head 5 which covers the master cylinder 3 or at the internal surface of a slave cylinder head 6 which covers the slave cylinder 4, respectively.

It may also be noted in FIGS. 1 to 8 that the travel end expansion valve 1 according to the invention comprises at least one expansion slave cylinder 13 which cooperates with the expansion master cylinder 12 and in which an expansion slave pump piston 15 can move so as to define with the slave cylinder 13 an expansion slave chamber 17 which has a variable volume and which is filled with a hydraulic fluid, the slave pump piston 15 being mechanically connected to the expansion main master piston 14 by a lever type transmission 11 with progressive effect which is arranged in such a manner that, when the expansion main master piston 14 is at the top dead center, the expansion slave pump piston 15 is at the bottom dead center, and vice versa, while the maximum volume of the expansion slave chamber 17 is less than the maximum volume of the expansion master chamber 16.

It should be noted that the lever type transmission 11 with progressive effect defines between the expansion main master piston 14 and the expansion slave pump piston 15 such a transmission relationship that, when the main master piston 14 is placed at its top dead center position and consequently the volume of the expansion master chamber 16 is at a minimum, the main master piston 14 cannot move—in spite of the pressure of the hydraulic fluid to which it is exposed—and consequently drive the expansion slave pump piston 15, while the further the expansion main master piston 14 is away from the top dead center position, the greater is the effort which it is capable of transmitting to the expansion slave pump piston 15, as is its capacity to move the slave pump piston 15. It should further be noted that the expansion main master piston 14 and/or the expansion slave pump piston 15 may comprise at least one joint and/or at least one sealing segment.

FIGS. 1 to 8 show that the travel end expansion valve 1 according to the invention comprises at least one expansion slave intake valve member 26 which opens in the expansion slave chamber 17 and which allows a hydraulic fluid which is contained in an expansion slave intake conduit 28 to be introduced into the slave chamber 17 but not to be discharged therefrom.

FIGS. 1 to 8 also show that the travel end expansion valve 1 comprises at least one expansion slave discharge valve member 27 which opens in the expansion slave chamber 17 and which allows a hydraulic fluid which is contained in an expansion slave discharge conduit 29 to be discharged from the slave chamber 17 but not to be introduced therein.

It should further be noted that the expansion slave intake valve member 26 and/or the expansion slave discharge valve member 27 can be fitted in an expansion slave cylinder head 45 which blocks an end of the expansion slave cylinder 13 or in the closed end of the cylinder 13 if it is a closed cylinder.

It may be noted in FIGS. 1 to 8 that the travel end expansion valve 1 according to the invention also comprises at least one expansion release actuator 30 which can, by means of contact or a mechanical connection, cause to move the lever type transmission 11 with progressive effect or can release it so as to cause the expansion main master piston 14 and the expansion slave pump piston 15 to move when the expansion main master piston 14 is placed at or in the region of the top dead center position thereof, in order to, for example, achieve a transmission relationship between the pistons 14, 15 that is sufficient for the expansion main master piston 14 to be able to continue to travel without the assistance of the expansion release actuator 30.

It should be set out specifically that the expansion release actuator 30 may be hydraulic, electro-hydraulic, electric, pneumatic or, generally, of any type known to the person skilled in the art. Furthermore, the expansion release actuator 30 may be controlled by a control processor of the pressure converter 55 which controls or cooperates in order to control the operation of the piston type pressure converter 2.

As FIGS. 1 and 2 illustrate, the expansion slave intake conduit 28 which is connected via the expansion slave intake valve member 26 to the expansion slave chamber 17 which cooperates with the expansion master chamber 16 which has a variable volume and which communicates with the slave chamber 10 may be connected to the slave intake conduit 24 while the expansion slave discharge conduit 29 which is connected to the same expansion slave chamber 17 may be connected to the slave discharge conduit 25.

According to a configuration which is not illustrated in the Figures, the expansion slave intake conduit 28 which is connected via the expansion slave intake valve member 26 to the expansion slave chamber 17 which cooperates with the expansion master chamber 16 which has a variable volume and which communicates with the master chamber 9 may be connected to the master discharge conduit 23 while the expansion slave discharge conduit 29 which is connected to the same expansion slave chamber 17 may be connected—upstream of the master intake valve 18—to the master intake conduit 22.

FIGS. 3 to 8 show that the lever type transmission 11 with progressive effect may comprise an expansion piston return spring 33 which tends to maintain the expansion main master piston 14 in the region of the position thereof in which the expansion master chamber 16 has the smallest volume while, at the same time, the spring 33 allows the expansion slave pump piston 15 to be maintained in the region of the position thereof in which the expansion slave chamber 17 has the largest volume, the spring 33 being able to be a torsion spring, flexion spring, draw spring or compression spring and to be of any type known to the person skilled in the art.

FIGS. 3 to 6 themselves show that, in accordance with the travel end expansion valve 1 according to the invention, the lever type transmission 11 with progressive effect may be constituted by a crankshaft 46 which can rotate in a crankshaft bearing 47 and which comprises an expansion master piston crank 35 whose cranked crankpin 48 is connected to an expansion main master piston axle 49 which is fitted in the expansion main master piston 14 by an expansion master piston connecting rod 34, the first end of which is articulated about the crankpin 48 and the second end of which is articulated about the axle 49, the crankshaft 46 cooperating with secondary expansion transmission means 51 which mechanically connect the shaft 46 to the expansion slave pump piston 15.

Figure 3:
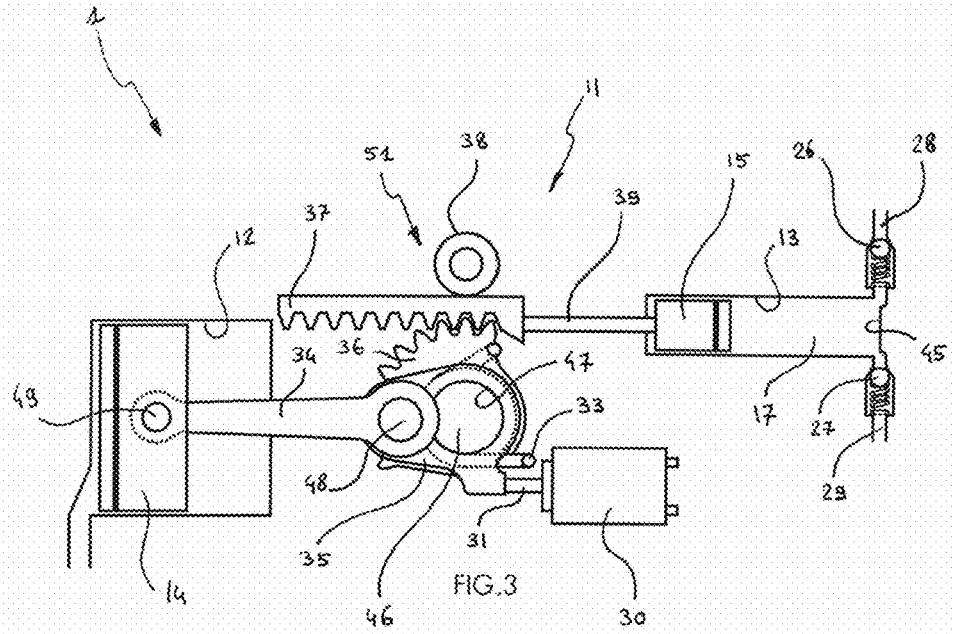
FIGS. 3 and 4 are schematic sections which illustrate the operation of the travel end expansion valve for a piston type pressure converter according to the present invention and according to a variant in which the lever type transmission with progressive effect is constituted by a crankshaft comprising an expansion master piston crank whose cranked crankpin is connected to an expansion main master piston axle which is fitted in the expansion main master piston by an expansion master piston connecting rod, the crankshaft cooperating with secondary expansion transmission means which are constituted in particular by an expansion transmission toothed wheel and an expansion transmission rack.
Figure 4:
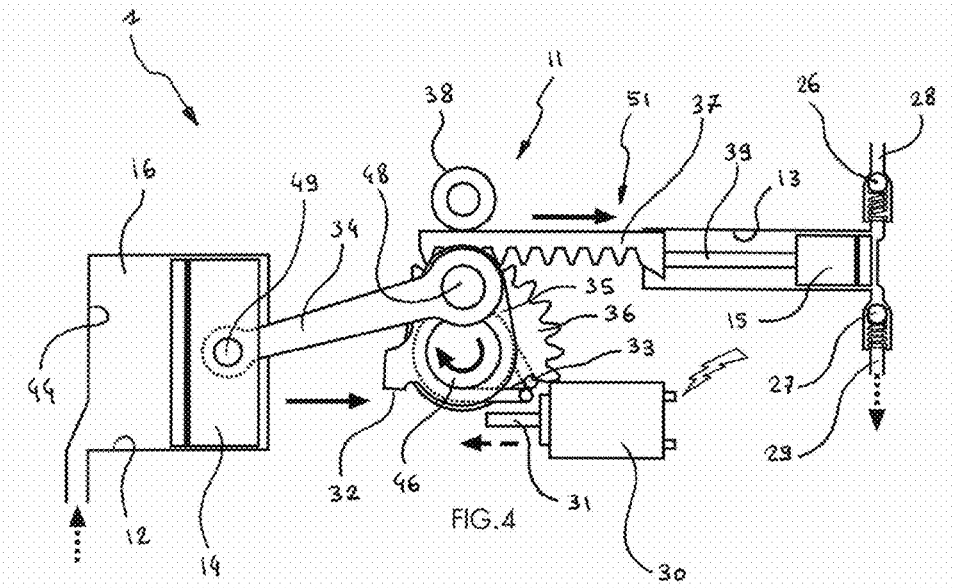

FIGS. 3 and 4 show that the secondary expansion transmission means 51 may be constituted by an expansion transmission toothed wheel 36 which is fixedly joined in terms of rotation to the crankshaft 46 and which, when it rotates, brings about a linear translation of an expansion transmission rack 37 which is connected to the expansion slave pump piston 15 directly or by means of an expansion slave piston thrust member 39.

It may be noted that the expansion transmission rack 37 may be guided, in particular by at least one expansion rack guiding roller 38.

Figure 5:
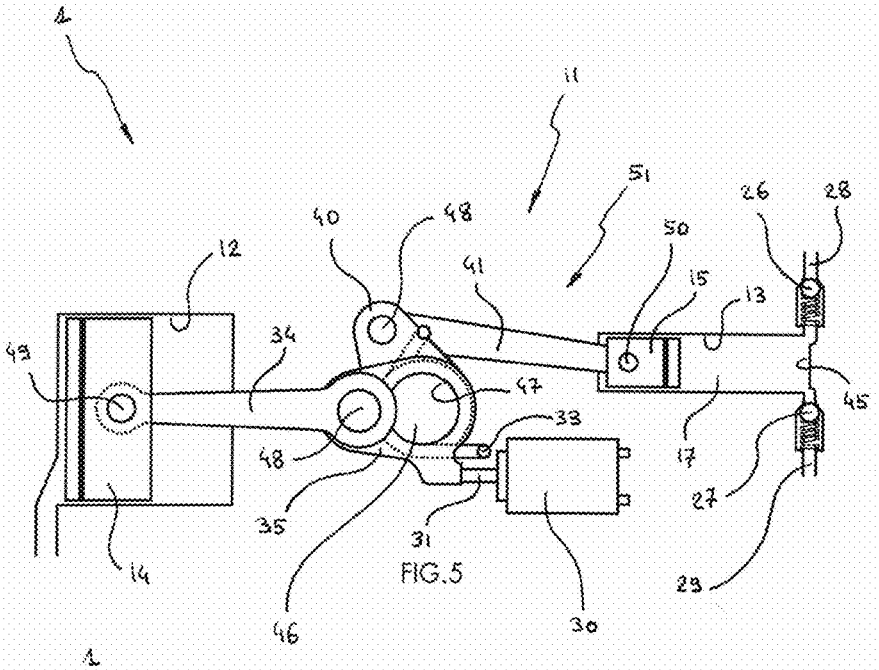
FIGS. 5 and 6 are schematic sections which illustrate the operation of the travel end expansion valve for a piston type pressure converter according to the present invention and according to a variant in which the lever type transmission with progressive effect is constituted by a crankshaft comprising an expansion master piston crank whose cranked crankpin is connected to an expansion main master piston axle which is fitted in the expansion main master piston by an expansion master piston connecting rod, the crankshaft cooperating with secondary expansion transmission means which are constituted in particular by an expansion slave piston crank whose cranked crankpin is connected to an expansion slave pump piston axle which is fitted in the expansion slave pump piston by an expansion slave piston connecting rod.
Figure 6:
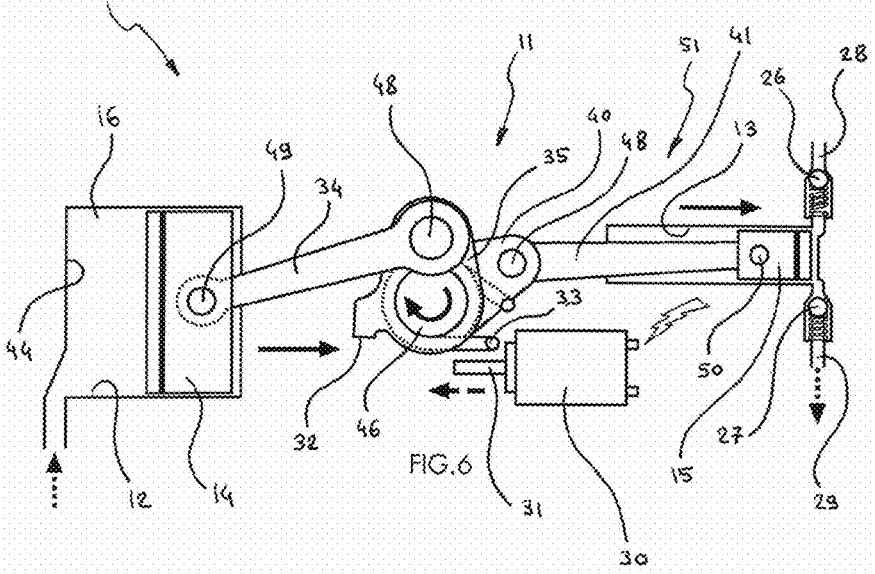

According to the specific configuration set out in FIGS. 5 and 6, the secondary expansion transmission means 51 may be constituted by an expansion slave piston crank 40 which is fixedly joined in terms of rotation to the crankshaft 46 and whose cranked crankpin 48 is connected to an expansion slave pump piston axle 50 which is fitted in the expansion slave pump piston 15 by an expansion slave piston connecting rod 41, the first end of which is articulated about the crankpin 48 and the second end of which is articulated about the axle 50.

It will readily be understood that, according to a variant which is not illustrated, the secondary expansion transmission means 51 may also be constituted by a cam which is fixedly joined in terms of rotation to the crankshaft 46 and which can be maintained in contact with the expansion slave pump piston 15.

Figure 7:
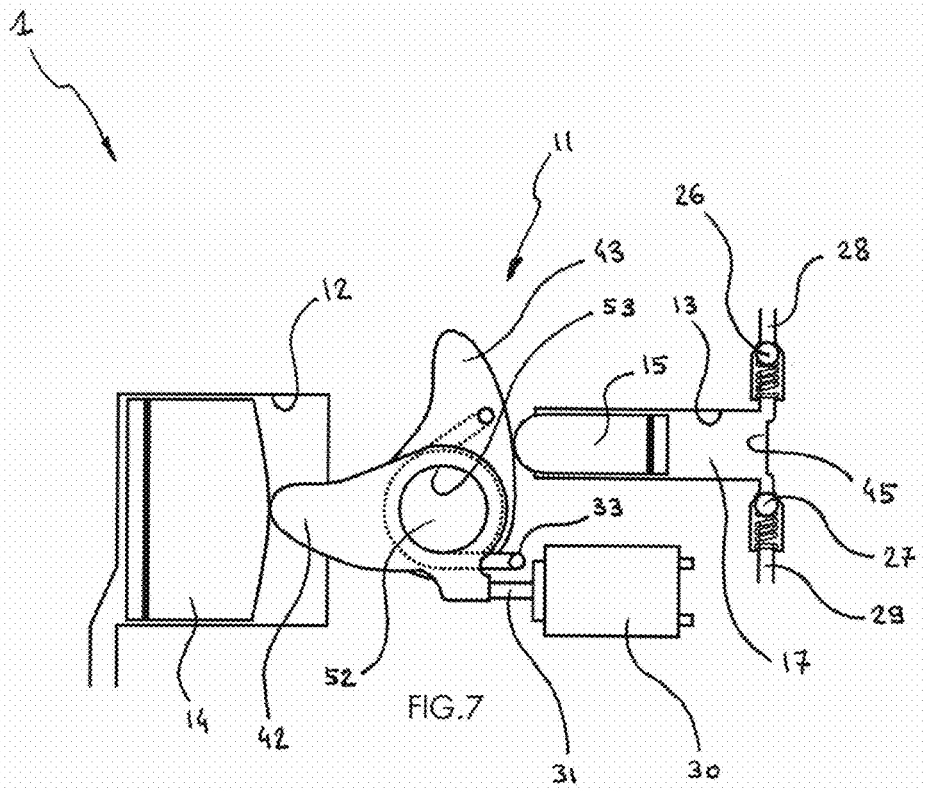
FIGS. 7 and 8 are schematic sections which illustrate the operation of the travel end expansion valve for a piston type pressure converter according to the present invention and according to a variant in which the lever type transmission with progressive effect is constituted by a camshaft comprising an expansion master piston cam which can be maintained in contact with the expansion main master piston, and an expansion slave piston cam which can be maintained in contact with the expansion slave pump piston.
Figure 8:
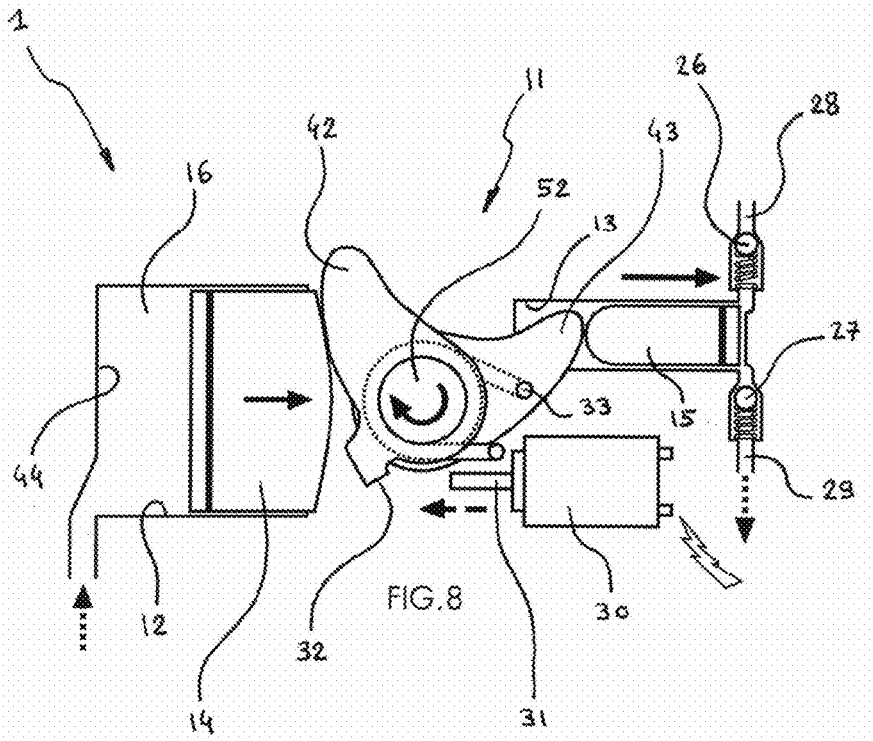

By way of a variant as set out in FIGS. 7 and 8, the lever type transmission 11 with progressive effect may be constituted by a camshaft 52 which can rotate in a camshaft bearing 53 and which comprises an expansion master piston cam 42 which can be maintained in contact with the expansion main master piston 14 and an expansion slave piston cam 43 which can be maintained in contact with the expansion slave pump piston 15.

As an alternative which is not illustrated, the expansion slave piston cam 43 may be replaced by a crank which is fixedly joined in terms of rotation to the camshaft 52, the crank comprising a crankpin which is connected to an axle which is fitted in the expansion slave pump piston 15 by a connecting rod, the first end of which is articulated about the crankpin and the second end of which is articulated about the axle.

It may be noted that the crankshaft 46 or the expansion master piston crank 35 or the expansion master piston connecting rod 34 or the expansion transmission toothed wheel 36 or the expansion transmission rack 37 or the expansion slave piston crank 40 or the expansion slave piston connecting rod 41 or the camshaft 52 or the expansion master piston cam 42 or the expansion slave piston cam 43 may have an expansion release push stop 32, to which the expansion release actuator 30 may apply an effort by means of an expansion release touch needle 31 in order to cause the expansion main master piston 14 and the expansion slave pump piston 15 to move at the suitable time when the expansion main master piston 14 is placed at or in the region of the top dead center position.

It may be noted that FIGS. 1 to 8 show a variant according to which the expansion release push stop 32 is provided on the expansion master piston crank 35.

Operation of the Invention

On the basis of the above description and in relation to the FIGS. 1 to 8, the operation of the travel end expansion valve 1 for a hydraulic pressure converter 2 according to the present invention will be understood.

It has been chosen here to illustrate the operation of the expansion valve 1 using it to recover the compression energy from a hydraulic fluid used in a piston type pressure converter 2 which is used as a pressure reducer and of which two configurations are schematically illustrated in FIGS. 1 and 2. For the sake of greater simplicity, there will mainly be considered the diagram of FIG. 1 which sets out a piston type pressure converter 2 having a single master chamber 9 and a single slave chamber 10.

The application illustrated in FIG. 1 is intended to convert energy stored in the form of compressed nitrogen in a high-pressure fluid reservoir 58 into electricity by means of an electricity generator 62 which is driven by a medium-pressure hydraulic motor 59. The compressed nitrogen communicates its pressure to a hydraulic fluid which may in particular flow in the conduits 64.

In order to achieve the objective defined, therefore, there has been interposed between the high-pressure fluid reservoir 58 and the medium-pressure hydraulic motor 59 a piston type pressure converter 2 which converts a high-pressure flow of hydraulic fluid which is discharged from the reservoir 58 into a medium-pressure flow of hydraulic fluid, that flow being introduced into the medium-pressure hydraulic motor 59 via an inlet conduit of the hydraulic motor 60. In order to filter the pulses generated by the operation of the piston type pressure converter 2, it may be noted that the inlet conduit of the hydraulic motor 60 comprises—according to this example—a medium-pressure fluid reservoir 57.

It will be understood from consideration of FIG. 1 that, in order to generate a medium-pressure flow of hydraulic fluid which is introduced into the medium-pressure hydraulic motor 59, it is necessary to place the high-pressure fluid reservoir 58 in communication with the master chamber 9. To that end, the control processor of the pressure converter 55 opens the master intake valve 18 which allows the hydraulic fluid which is contained in the high-pressure fluid reservoir 58 to be introduced into the master chamber 9 via the master intake conduit 22. However, the processor 55 simultaneously prevents the fluid from being discharged from the chamber 9 in order to move toward the master outlet low-pressure fluid reservoir 56, the processor 55 to that end keeping the master discharge valve 19 closed. In this manner, the hydraulic fluid under high pressure from the reservoir 58 may push on the main master piston 7, which moves in the direction d2, which has the effect of moving the slave pump piston 8 in the same direction, over the same distance and at the same speed.

During movement in the direction d2, the slave pump piston 8 compresses the hydraulic fluid which the slave chamber 10 contains, which has the effect of discharging the fluid into the slave discharge conduit 25 via the slave discharge valve member 21. The fluid is then conveyed via a conduit 64 as far as the inlet conduit of the hydraulic motor 60 which has the effect of causing to rotate the medium-pressure hydraulic motor 59 and consequently the electricity generator 62, which produces electricity.

The position sensor of the pressure converter pistons 54 permanently returns the position of the slave pump piston 8 to the control processor of the pressure converter 55. When the slave pump piston 8 reaches a location near the slave cylinder head 6, the processor 55 closes the master intake valve 18 so as to stop the movement of the slave pump piston 8 in the direction d2 before it touches the cylinder head 6, and so that the piston 8 remains at a given distance from the cylinder head 6.

Before the main master piston 7 and the slave pump piston 8 can move away again in the opposite direction in the direction d1, it is advantageous to decompress the master chamber 9. If the situation remains as allowed in the prior art, the control processor of the pressure converter 55 would at this stage have to open the master discharge valve 19 in order to decompress the chamber 9 in the master outlet low-pressure fluid reservoir 56, which would have the effect of dissipating the compression energy of the hydraulic fluid which is contained in the master chamber 9, the energy no longer being able to be definitively converted into an additional flow of hydraulic fluid being discharged from the slave discharge conduit 25.

In order to prevent this energy loss, at this stage the travel end expansion valve 1 for a piston type pressure converter 2 according to the present invention provides for the control processor of the pressure converter 55 not to open the master discharge valve 19 yet so that the expansion valve 1 can produce the effects thereof and recover the compression energy of the hydraulic fluid which is contained in the master chamber 9.

To that end, immediately after the master intake valve 18 has been closed, the control processor of the pressure converter 55 supplies the expansion release actuator 30 with electric current, which has the effect of causing to move the lever type transmission 11 with progressive effect and, consequently, causing to move the expansion main master piston 14 and the expansion slave pump piston 15, the expansion main master piston 14 being positioned at the top dead center thereof until that time.

In order to set out in detail the operation of the travel end expansion valve 1 according to the invention, there has been selected here the embodiment of the lever type transmission 11 with progressive effect which is illustrated in FIGS. 3 and 4.

FIG. 3 shows the state in which the travel end expansion valve 1 according to the invention was located as long as the main master piston 7 and the slave pump piston 8 were moving in the direction d2. It will be noted that the expansion main master piston 14 remained blocked at the top dead center thereof because the pressure that the hydraulic fluid which is contained in the slave chamber 10 applied to the piston 14 tended to rotate the crankshaft 46 in the counter-clockwise direction. The fact that the expansion main master piston 14 remained blocked results from the fact that—according to this specific embodiment illustrated in FIGS. 3 and 4—when the piston 14 is positioned at the top dead center thereof, the rotation axis of the cranked crankpin 48 is substantially misaligned downward in relation to the straight line which connects the rotation axis of the expansion main master piston axle 49 and the rotation axis of the crankshaft 46, while the center of rotation of the expansion main master piston axle 49 and the axis of the expansion master cylinder 12 are perpendicular and intersecting, and the same is true for the rotation axis of the crankshaft 46 and the axis of the cylinder 12.

It may be noted—still in FIG. 3—that it was also impossible for the expansion main master piston 14 to further rotate the crankshaft 46 in the counter-clockwise direction because the expansion release push stop 32 which the expansion master piston crank 35 comprises abutted the expansion release touch needle 31, the needle 31 being maintained in a fixed position by the expansion release actuator 30.

It may also be noted—in addition to what has been set out above—that the expansion piston return spring 33 tends to rotate the crankshaft 46 in the counter-clockwise direction and, therefore, to maintain the expansion release push stop 32 in contact with the expansion release touch needle 31.

It will be understood with consideration of FIGS. 3 and 4 that, as soon as the control processor of the pressure converter 55 supplies the expansion release actuator 30 with electric current, the actuator 30 repels the expansion release touch needle 31 which, in turn pushing against the expansion release push stop 32 which the expansion master piston crank 35 comprises, rotates the crankshaft 46 by a few degrees in the clockwise direction so as to change the misalignment of the rotation axis of the cranked crankpin 48 from a position below to one above the straight line which connects the rotation axis of the expansion main master piston axle 49 and the rotation axis of the crankshaft 46.

As a result, the thrust which the expansion main master piston 14 produces under the effect of the pressure of the hydraulic fluid which the slave chamber 10 contains—the pressure being passed on to the expansion master chamber 16, those two chambers 10 and 16 being communicating—tends from that time to rotate the crankshaft 46 in the clockwise direction, which becomes possible because only the expansion slave pump piston 15 and the expansion piston return spring 33 tend to act from that time counter to that rotation without, however, being able to prevent it.

Bearing in mind that the master intake valve 18 and the master discharge valve 19 are both closed, the main master piston 7 and the slave pump piston 8 are temporarily in the stopped state. Correlatively, as long as the expansion main master piston 14 is in the region of the top dead center thereof, the pressure prevailing in the master chamber 9 corresponds approximately to the pressure prevailing in the high-pressure fluid reservoir 58; however, the pressure prevailing in the slave chamber 10 is equivalent to the pressure which previously prevailed in the intake conduit of the hydraulic motor 60.

This is the stage at which the function of the travel end expansion valve 1 for a piston type pressure converter 2 according to the present invention becomes decisive because the expansion valve 1 will decompress the master chamber 9 and the slave chamber 10 and use this decompression in order to generate an additional flow of hydraulic fluid available in the region of the intake conduit of the hydraulic motor 60, the pressure of the fluid being substantially equivalent to that which prevailed in the conduit 60 when the main master piston 7 and the slave pump piston 8 moved to this location in the direction d2.

It may be noted in FIGS. 3 and 4 that the expansion main master piston 14 exposes to the pressure of the hydraulic fluid a cross-section which is far greater than the cross-section which the expansion slave pump piston 15 exposes.

It may be noted—still in the same Figures—that the transmission relationship between the expansion main master piston 14 and the expansion slave pump piston 15 is great or infinitely large when the main master piston 14 is positioned on or in the region of the top dead center thereof, and small when the main master piston 14 is positioned at the bottom dead center. It may also be noted that, advantageously, the complete travel of the expansion main master piston 14 is brought about over only quarter of a revolution of the crankshaft 46.

That decreasing transmission relationship results—firstly—from the system which the expansion master piston connecting rod 34 and the expansion master piston crank 35 constitute, the system providing a lever arm which is short or infinitely short for the expansion main master piston 14 in order to rotate the crankshaft 46 when the piston 14 is at or in the region of the top dead center thereof, the lever arm being at a maximum when the piston 14 is at the bottom dead center thereof. That decreasing transmission relationship results—secondly—from the fact that, unlike the expansion main master piston 14, the driving in terms of linear translation of the expansion slave pump piston 15 by the crankshaft 46 is brought about with a constant lever since the secondary expansion transmission means 51 in question are constituted—according to this non-limiting embodiment—by an expansion transmission toothed wheel 36 which drives an expansion transmission rack 37.

The difference in cross-section and the variable transmission relationship between the expansion main master piston 14 and the expansion slave pump piston 15 allow expansion of the hydraulic fluid which is contained in the master chamber 9 and the slave chamber 10 under the desired conditions, that is to say, using that expansion in order to generate an additional flow of medium-pressure hydraulic fluid which is available in the region of the intake conduit of the hydraulic motor 60.

At the start of expansion—that is to say, when the expansion main master piston 14 is in the region of the top dead center thereof—the pressure prevailing in the slave chamber 10 is substantially equal to the desired pressure in the region of the intake conduit of the hydraulic motor 60. The effort which the pressure prevailing in the slave chamber 10 applies to the expansion main master piston 14 is—for example—ten times greater than the pressure which it is necessary to apply to the expansion slave pump piston 15 so that it produces the desired pressure in the expansion slave chamber 17. However, the instantaneous transmission relationship between the expansion main master piston 14 and the expansion slave pump piston 15 is—for example— one to ten. In that case, the expansion slave pump piston 15 correctly pressurizes the expansion slave chamber 17 with which it cooperates to the desired pressure, in such a manner that it begins to discharge the hydraulic fluid which it contains from the slave chamber 17 into the expansion slave discharge conduit 29 via the expansion slave discharge valve member 27.

At this stage, the main master piston 7 and the slave pump piston 8 begin to move substantially in the direction d2 under the effect of the expansion of the master chamber 9.

In the course of the expansion of the master chamber 9, the expansion main master piston 14 moves in the direction of the bottom dead center thereof while the pressure which it receives from the hydraulic fluid from the slave chamber 10 decreases. In so doing, the transmission relationship between the piston 14 and the expansion slave pump piston 15 increases in order to reach approximately one when the expansion main master piston 14 reaches the bottom dead center thereof.

In this manner, while the pressure prevailing in the master chamber 9 and the slave chamber 10 was falling, the pressure of the hydraulic fluid discharged from the expansion slave chamber 17 by the expansion slave pump piston 15 via the expansion slave discharge valve member 27 remained relatively constant. Since the flow being introduced into the medium-pressure hydraulic motor 59 remained constant during this sequence, the rotation speed of the crankshaft 46 increased correlatively to the decompression of the master chamber 9 and slave chamber 10, the decompression also having brought about a movement in the direction d2 and over a short distance from the main master piston 7 and the slave pump piston 8.

Once the master chamber 9 and the slave chamber 10 are decompressed, the control processor of the pressure converter 55 may open the master discharge valve 19. As a result, the main master piston 7 and the slave pump piston 8 move rapidly in the direction d1 under the effect of the pressure which the hydraulic fluid which is contained in the low-pressure slave inlet fluid reservoir 63 applies to the entire cross-section of the slave pump piston 8, via the slave intake valve member 20. When the main master piston 7 reaches a location near the master cylinder head 5, the control processor of the pressure converter 55 closes the master discharge valve 19, and the main master piston 7 and the slave pump piston 8 stop moving in the direction d1.

In so doing, the expansion piston return spring 33 moves the expansion main master piston 14 to the top dead center and moves the expansion release push stop 32 into contact with the expansion release touch needle 31. Simultaneously, the expansion slave pump piston 15 moves back to the bottom dead center thereof and draws in—via the expansion slave intake valve member 26—hydraulic fluid from the low-pressure slave inlet fluid reservoir 63 so as to fill the expansion slave chamber 17.

In this manner, the main master piston 7 and the slave pump piston 8 of the piston type pressure converter 2 are ready to carry out new travel in the direction d2 in order to convert the high-pressure flow of hydraulic fluid being discharged from the high-pressure fluid reservoir 58 into a medium-pressure flow of hydraulic fluid being introduced into the medium-pressure hydraulic motor 59 before leaving it again via the outlet conduit of the hydraulic motor 61 in order finally to open in a hydraulic fluid tank 65.

Furthermore, the travel end expansion valve 1 according to the invention is again ready to decompress the master chamber 9 and to recover the compression energy of the hydraulic fluid which is contained in the chamber 9 when the slave pump piston 8 again reaches a position near the slave cylinder head 6.

The related operation of the variants of the travel end expansion valve 1 for a piston type pressure converter 2 according to the invention as illustrated in FIGS. 5 to 8 will readily be understood. Any possible application of the expansion valve 1 will also readily be understood, whether this involves the one set out in FIG. 2, or any other, without any limitation, whether or not it is applied to a pressure converter or any other machine which may or may not be known to the person skilled in the art and which provides with the travel end expansion valve 1 according to the invention a solution for the recovery of the compression energy which is contained in any liquid or gaseous fluid.

It must be understood that the description above has been given only by way of example and that it does not limit in any manner the scope of the invention, which will not be exceeded by replacing the implementation details described with any other equivalent feature.

The invention claimed is:

1. Travel end expansion valve (1) which is provided for a piston type pressure converter (2) which comprises at least one master cylinder (3) in which a main master piston (7) can move so as to define a master chamber (9) which has a variable volume and which can be placed in a relationship with a master intake conduit (22) by a master intake valve (18) or with a master discharge conduit (23) by a master discharge valve (19), the pressure converter (2) also comprising at least one slave cylinder (4), in which a slave pump piston (8) can move so as to define a slave chamber (10) which also has a variable volume, the chamber (10) being able to admit a hydraulic fluid from a slave intake conduit (24) via a slave intake valve member (20) or to discharge the fluid into a slave discharge conduit (25) via a slave discharge valve member (21), the master chamber (9) and the slave chamber (10) each being filled with a hydraulic fluid, characterized in that it comprises:

at least one expansion master cylinder (12) which is filled with a hydraulic fluid and in which an expansion main master piston (14) can move so as to define an expansion master chamber (16) which has a variable volume and which communicates with the master chamber (9) and/or at least one expansion master cylinder (12) which is filled with a hydraulic fluid and in which an expansion main master piston (14) can move so as to define an expansion master chamber (16) which has a variable volume and which communicates with the slave chamber (10);

at least one expansion slave cylinder (13) which cooperates with the expansion master cylinder (12) and in which an expansion slave pump piston (15) can move so as to define with the slave cylinder (13) an expansion slave chamber (17) which has a variable volume and which is filled with a hydraulic fluid, the slave pump piston (15) being mechanically connected to the expansion main master piston (14) by a lever type transmission (11) which has a progressive effect and which is arranged in such a manner that, when the expansion main master piston (14) is at the top dead center, the expansion slave pump piston (15) is at the bottom dead center, and vice versa;

at least one expansion slave intake valve member (26) which opens in the expansion slave chamber (17) and which allows a hydraulic fluid which is contained in an expansion slave intake conduit (28) to be introduced into the slave chamber (17) but not to be discharged therefrom;

at least one expansion slave discharge valve member (27) which opens in the expansion slave chamber (17) and which allows a hydraulic fluid which is contained in an expansion slave discharge conduit (29) to be discharged from the slave chamber (17) but not to be introduced therein;

at least one expansion release actuator (30) which can, by means of contact or mechanical connection, cause to move or release the lever type transmission (11) with progressive effect.

2. Travel end expansion valve (1) according to claim 1, characterized in that the expansion slave intake conduit (28) which is connected via the expansion slave intake valve member (26) to the expansion slave chamber (17) which cooperates with the expansion master chamber (16) which has a variable volume and which communicates with the slave chamber (10) is connected to the slave intake conduit (24) while the expansion slave discharge conduit (29) which is connected to the same expansion slave chamber (17) is connected to the slave discharge conduit (25).

3. Travel end expansion valve (1) according to claim 1, characterized in that the expansion slave intake conduit (28) which is connected via the expansion slave intake valve member (26) to the expansion slave chamber (17) which cooperates with the expansion master chamber (16) which has a variable volume and which communicates with the master chamber (9) is connected to the master discharge conduit (23) while the expansion slave discharge conduit (29) which is connected to the same expansion slave chamber (17) is connected—upstream of the master intake valve (18)—to the master intake conduit (22).

4. Travel end expansion valve (1) according to claim 1, characterized in that the lever type transmission (11) with progressive effect comprises an expansion piston return spring (33) which tends to maintain the expansion main master piston (14) in the region of the position thereof in which the expansion master chamber (16) has the smallest volume while, simultaneously, the spring (33) allows the expansion slave pump piston (15) to be maintained in the region of the position thereof in which the expansion slave chamber (17) has the largest volume.

5. Travel end expansion valve (1) according to claim 1, characterized in that the lever type transmission (11) with progressive effect is constituted by a crankshaft (46) which can rotate in a crankshaft bearing (47) and which comprises an expansion master piston crank (35) whose cranked crankpin (48) is connected to an expansion main master piston axle (49) which is fitted in the expansion main master piston (14) by an expansion master piston connecting rod (34), the first end of which is articulated about the crankpin (48) and the second end of which is articulated about the axle (49), the crankshaft (46) cooperating with secondary expansion transmission means (51) which mechanically connect the shaft (46) to the expansion slave pump piston (15).

6. Travel end expansion valve (1) according to claim 5, characterized in that the secondary expansion transmission means (51) are constituted by an expansion transmission toothed wheel (36) which is fixedly joined in terms of rotation to the crankshaft (46) and which, when it rotates, drives in terms of linear translation an expansion transmission rack (37) which is connected to the expansion slave pump piston (15).

7. Travel end expansion valve (1) according to claim 6, characterized in that the crankshaft (46) or the expansion master piston crank (35) or the expansion master piston connecting rod (34) or the expansion transmission toothed wheel (36) or the expansion transmission rack (37) or the expansion slave piston crank (40) or the expansion slave piston connecting rod (41) or the camshaft (52) or the expansion master piston cam (42) or the expansion slave piston cam (43) has an expansion release push stop (32) to which the expansion release actuator (30) can apply an effort by means of an expansion release touch needle (31).

8. Travel end expansion valve (1) according to claim 5, characterized in that the secondary expansion transmission means (51) are constituted by an expansion slave piston crank (40) which is fixedly joined in terms of rotation to the crankshaft (46) and the cranked crankpin (48) of which is connected to an expansion slave pump piston axle (50) which is fitted in the expansion slave pump piston (15) by an expansion slave piston connecting rod (41), the first end of which is articulated about the crankpin (48) and the second end of which is articulated about the axle (50).

9. Travel end expansion valve (1) according to claim 8, characterized in that the crankshaft (46) or the expansion master piston crank (35) or the expansion master piston connecting rod (34) or the expansion transmission toothed wheel (36) or the expansion transmission rack (37) or the expansion slave piston crank (40) or the expansion slave piston connecting rod (41) or the camshaft (52) or the expansion master piston cam (42) or the expansion slave piston cam (43) has an expansion release push stop (32) to which the expansion release actuator (30) can apply an effort by means of an expansion release touch needle (31).

10. Travel end expansion valve (1) according to claim 1, characterized in that the lever type transmission (11) with progressive effect is constituted by a camshaft (52) which can rotate in a camshaft bearing (53) and which comprises an expansion master piston cam (42) which can be maintained in contact with the expansion main master piston (14) and an expansion slave piston cam (43) which can be maintained in contact with the expansion slave pump piston (15).

11. Travel end expansion valve (1) according to claim 5, characterized in that the crankshaft (46) or the expansion master piston crank (35) or the expansion master piston connecting rod (34) or the expansion transmission toothed wheel (36) or the expansion transmission rack (37) or the expansion slave piston crank (40) or the expansion slave piston connecting rod (41) or the camshaft (52) or the expansion master piston cam (42) or the expansion slave piston cam (43) has an expansion release push stop (32) to which the expansion release actuator (30) can apply an effort by means of an expansion release touch needle (31).

12. Travel end expansion valve (1) according to claim 10, characterized in that the crankshaft (46) or the expansion master piston crank (35) or the expansion master piston connecting rod (34) or the expansion transmission toothed wheel (36) or the expansion transmission rack (37) or the expansion slave piston crank (40) or the expansion slave piston connecting rod (41) or the camshaft (52) or the expansion master piston cam (42) or the expansion slave piston cam (43) has an expansion release push stop (32) to which the expansion release actuator (30) can apply an effort by means of an expansion release touch needle (31).

* * * * *